United States Patent [19]

Broglio

[11] Patent Number: 4,846,265

[45] Date of Patent: Jul. 11, 1989

[54] HEAT EXCHANGER WITH LIQUID CIRCULATION, PARTICULARLY FOR AN AUTOMOBILE, INCLUDING A LIQUID DEGASIFICATION PASSAGE

[75] Inventor: Marco Broglio, Torino, Italy

[73] Assignee: Valeo, Paris, France

[21] Appl. No.: 190,377

[22] Filed: May 5, 1988

[30] Foreign Application Priority Data

May 5, 1987 [FR] France ..... 87 06327

[51] Int. Cl.[4] ..... F01P 11/02; F01P 3/20

[52] U.S. Cl. ..... 165/104.32; 123/41.54; 165/917

[58] Field of Search ..... 165/104.32, 917; 123/41.54

[56] References Cited

U.S. PATENT DOCUMENTS 3,623,462 11/1971 Anders et al. ..... 123/41.54
4,491,174 1/1985 Villeval ..... 165/104.32
4,512,396 4/1985 Villeval ..... 123/41.54

FOREIGN PATENT DOCUMENTS 2514479 4/1983 France .
2514484 4/1983 France ..... 165/104.32

*Primary Examiner*—Albert W. Davis, Jr.
*Attorney, Agent, or Firm*—Dennison, Meserole, Pollack & Scheiner

[57] ABSTRACT

Heat exchanger comprising a cluster (10) of tubes in which a liquid coolant circulates, at least one collector reservoir (20) mounted at one end of the cluster, an expansion chamber (22) in communication with said collector reservoir at its bottom part and a liquid degasification passage connecting the collector reservoir (20) to the expansion chamber (22), this degasification passage comprising at least one tube (54) of the cluster (10) situated at a level below that of a transverse wall of the collector reservoir (20) as well as a conduit (60) which opens into the expansion chamber (22) and into the collector reservoir (20) facing and at some distance from the mouth (58) of the tube or tubes (54).

13 Claims, 1 Drawing Sheet

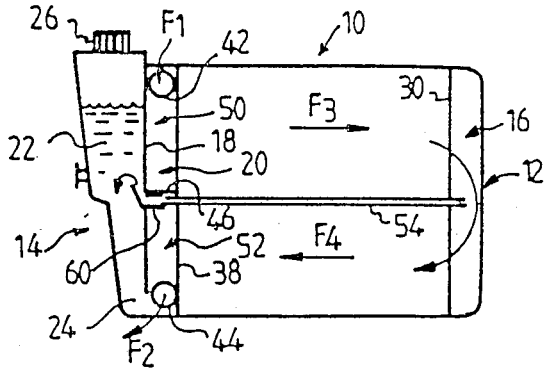
FIG. 1
FIG. 2
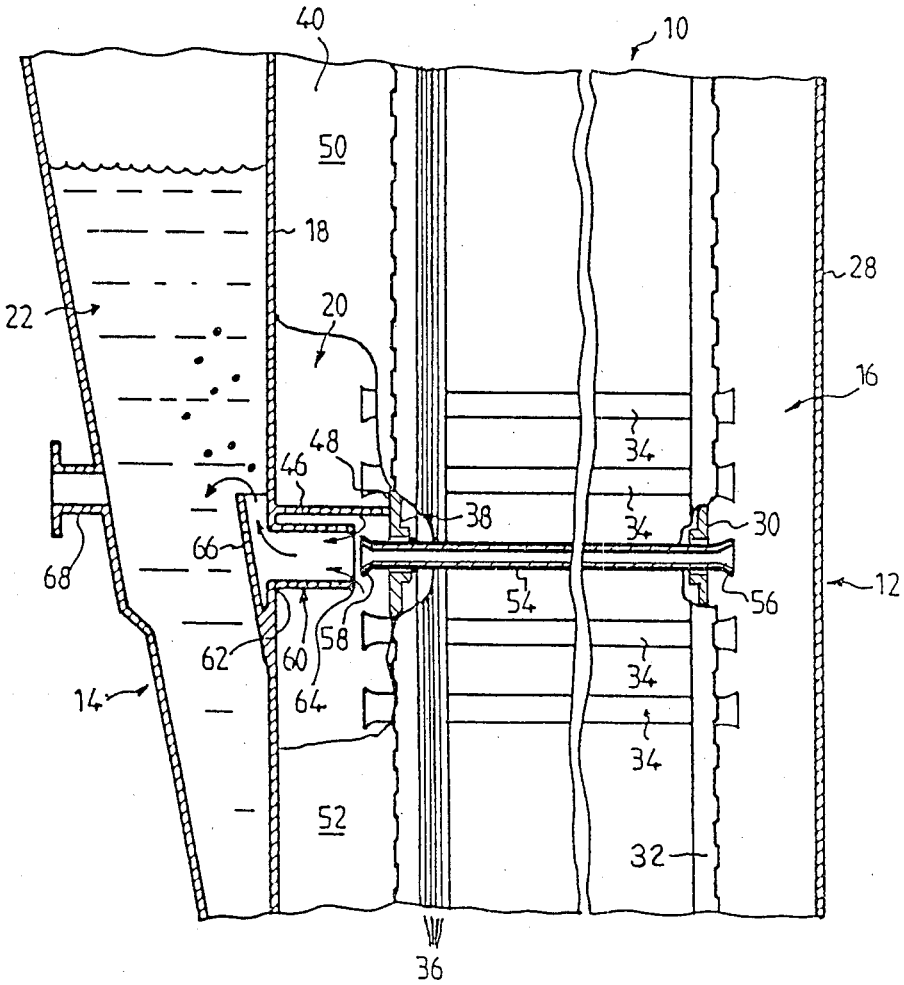

HEAT EXCHANGER WITH LIQUID CIRCULATION, PARTICULARLY FOR AN AUTOMOBILE, INCLUDING A LIQUID DEGASIFICATION PASSAGE

BACKGROUND OF THE INVENTION

The invention concerns a heat exchanger with liquid circulation, particularly a radiator which is a part of a cooling circuit for an internal combustion engine of an automobile.

It more precisely concerns a heat exchanger of the type comprising a cluster of tubes in which the liquid circulates, at least one collector reservoir mounted at one end of the cluster, an expansion chamber in communication with the bottom of the collector reservoir and a liquid degasification passage connecting the collector reservoir to the expansion chamber, the collector reservoir including within it at least one transverse wall situated above the level of the degasification passage.

A heat exchanger of this type is known particularly from French Patent application No. 81 19 272, published as No. 2 514 479, in the name of this applicant, corresponding to U.S. Pat. No. 4,491,174. This known heat exchanger comprises a cluster of tubes in which the liquid circulates, a first collector reservoir mounted at one end of the cluster, a second collector reservoir mounted at the other end of the cluster, an expansion chamber communicating with the second collector reservoir at the bottom and a liquid degasification passage connecting the first collector reservoir through the tube cluster to the expansion chamber, the second collector reservoir comprising a transverse wall, in this case a transverse partition, situated above the level of the liquid degasification passage and allowing the fluid to circulate in a U-shaped path through the tubes of the cluster.

In this known heat exchanger, the purpose of the degasification passage is to evacuate the air bubbles which are formed and are captured and held in the coolant liquid toward the expansion chamber, particularly the air bubbles which may be present in the first collector reservoir.

In fact, it is known that such bubbles which circulate in the cooling circuit of the engine have a tendency to gather together at certain points around the cylinder head of the engine while causing the risk of the appearance of "hot points" which can eventually deteriorate certain parts of the engine because of insufficient cooling.

In the heat exchanger which is known from the aforementioned French Patent application, the transverse wall is actually a transverse partition which is provided in the second collector reservoir, dividing this reservoir into two compartments, which are a bottom compartment and a top compartment, and which thus forces the liquid to circulate in one direction from the second collector reservoir toward the first collector reservoir and in the other direction from the first collector reservoir toward the second collector reservoir. The liquid thus circulates in the cluster of tubes following a U-shaped circuit path, which is called a "bi-circuit".

However, this known exchanger presents one major drawback, given that the air bubbles have a tendency to regroup and consolidate under said transverse partition in the bottom compartment of the second collector reservoir, without being able to be evacuated correctly toward the expansion chamber.

In addition to that, the realization of this degasification passage is relatively complex because it requires particularly a bent tube of which one end must be sealed communication with the expansion chamber.

In addition, it is known, in accordance with French Patent application No. 81 19179, published as No. 2 514 484, in the name of this applicant, to provide a degasification passage between a collector reservoir and an expansion chamber which communicate with each other and are situated at one end of a cluster of tubes. Nonetheless, this already disclosed passage does not efficiently solve the problem of the degasification of the collector reservoir situated at the other end of the cluster of tubes.

SUMMARY OF THE INVENTION

The particular object of the invention is to remedy the drawbacks of the degasification passages of exchangers which are already known in the prior art.

For this reason, the invention proposes a heat exchanger with liquid circulation, particularly for an automobile, comprising a cluster of tubes in which the liquid circulates, at least one collector reservoir mounted at one end of the cluster, an expansion chamber in communication with the collector reservoir at its bottom and a liquid degasification passage connecting the collector reservoir to the expansion chamber, the collector reservoir including within it at least one transverse wall situated above the level of the degasification passage.

Accordingly, the essential feature of the invention, this degasification passage, in this particular design, comprises at least one cluster tube situated at a level below that of the transverse wall as well as a conduit which opens on the one hand in the expansion chamber and on the other hand in the collector reservoir, facing and at some distance from the mouth of the aforementioned tube or tubes of the cluster.

Thus, according to the invention, the tube or tubes which make up a part of the degasification passage are constituted by tubes of the cluster in their normal function of liquid circulation. This degasification passage allows the evacuation toward the expansion chamber of the gas bubbles which may arise and which gather together under the transverse wall of the collector reservoir, in other words, the upper partition of said reservoir, and that as a result of a suction effect of the liquid circulating first through the tube or tubes of the cluster and then through the conduit, the bubbles are aspirated toward the conduit through the space which is present between the conduit and the mouth of the tube or tubes of the cluster.

According to another feature, the transverse wall is a transverse partition situated in the collector reservoir and dividing this reservoir into two compartments.

In addition, this degasification passage allows efficient removal of the bubbles gathering together in time in the collector reservoir.

In one preferred embodiment of the invention, the degasification passage comprises one single tube of the cluster, this tube being of generally cylindrical shape. The conduit also is of a generally cylindrical shape, and the tube and the conduit are in axial alignment with each other.

In order to obtain the aforementioned suction effect, it is preferable that the internal diameter of the cylindrical conduit be greater than the external diameter of the mouth of the tube of the cluster.

According to another advantageous characteristic of the invention, the conduit is situated in the immediate vicinity of the transverse partition in the first collector chamber, without, however, being fastened to this transverse partition.

According to another characteristic of the invention, the conduit which makes up a part of the degasification passage is a part of the configuration of the longitudinal partition which separates the collector reservoir and the expansion chamber and the conduit expands integrally into the second collector reservoir.

It is advantageous that the conduit be formed by casting or molding as one single piece integral with said longitudinal partition.

The invention also provides that the collector reservoir, the expansion chamber and the longitudinal partition which separates them be obtained by molding as one single piece.

In the following description, provided solely as an example, reference is made to the attached drawing.

BRIEF DESCRIPTION OF THE DRAWINGS

FIG. 1 is a diagrammatic view in longitundinal cross section of a heat exchanger according to the invention; and FIG. 2 is a partial view in larger scale and partially in cross section of the heat exchanger represented in FIG. 1.

DESCRIPTION OF PREFERRED EMBODIMENT

The heat exchanger shown in FIGS. 1 and 2 comprises a cluster 10 of tubes in generally horizontal arrangement, at the ends of which are mounted water reservoirs 12 and 14 into which open the ends of the tubes of cluster 10. Water reservoir 12 forms a first collector reservoir 16 into which open the ends of the tubes of cluster 10. Water reservoir 14 is subdivided by a longitudinal partition 18 into a second collector reservoir 20 into which open the corresponding ends of the tubes of cluster 10, and into an expansion chamber 22 which communicates at the bottom with collector reservoir 20 through a communication passage 24.

At the top, expansion chamber 22 comprises nipple member which can form a filling orifice and which may be closed by a cap 26 with clack-valves calibrated for overpressure and vacuum pressure.

Water reservoir 12, in the traditional manner, comprises a wall 28, provided advantageously by molding of a plastic material, and in its upright section having the general shape of a U and thus defining an open end of the reservoir. The open end of wall 28 is affixed on a collector or perforated plate 30 by means of a peripheral clamping member 32 (FIG. 2). The ends of the tubes 34 which compose cluster 10 pass through the holes of this collector in a sealed manner and are provided with cooling fins or flanges 36.

The other ends of tubes 34 pass through another collector or perforated plate 38 in a sealed manner and on this plate are mounted the lateral walls 40 of water reservoir 14. This reservoir is provided in one single piece by molding of a plastic material and it has a flared shape of which the cross section increases progressively from the bottom part of the water reservoir to its top part which includes the cap 26.

Water reservoir 14 also comprises, because it is molded directly with it, an inlet pipe 42 for the coolant liquid, as shown by the arrow F1, and a discharge pipe 44 for said liquid, as shown by the arrow F2.

Water reservoir 14 also includes a wall molded directly with it and forming a transverse partition 46 presenting one end 48 which, following mounting of water reservoir 14 on collector 38, comes into sealed abutment against said collector. Transverse partition 46 constitutes a separator partition which divides the second collector reservoir into two essentially equal compartments, in other words a top compartment 50 in communication with inlet pipe 42 and a bottom compartment 52 in communication with discharge pipe 44.

A U-shaped circulation of the coolant liquid is obtained by virtue of this particular arrangement of the second collector reservoir 20. The coolant of the engine enters into the top compartment 50 of collector reservoir 20 through inlet pipe 42, circulates in the tubes of the top half of cluster 10 as indicated by the arrows F3 and reaches the other collector reservoir 16, then circulates in the opposite direction, and indicated by arrows F4, in the tubes of the bottom half of cluster 10, reaches bottom compartment 52 of collector reservoir 20 and is discharged from the exchanger through pipe 44.

According to the invention, a degasification passage is provided in order to evacuate the air bubbles which may be caught and held by the coolant liquid and may be circulating in the coolant circuit toward expansion chamber 22.

The degasification passage, in the example which is shown, comprises a tube 54 which is a part of the cluster 10. This tube 54 is situated at a level below that of transverse partition 46 of the second collector reservoir 20 and thus serves to cause the liquid to circulate from the first collector reservoir 16 in the direction of and as far as second collector reservoir 20 and even more particularly toward compartment 52 of this second collector reservoir. One end of tube 54 presents a mouth 56 of flared shape, as is known in and of itself, which opens into the interior of first collector reservoir 16 and, at its other end, has another mouth 58, also of flared shape, which opens into compartment 52, immediately below partition 46.

The degasification passage additionally comprises a conduit 60 of generally cylindrical shape which opens, through a first end 62, into expansion chamber 22 and through its other end 64, facing and spaced from the mouth 58 of tube 54, conduit 60 is aligned axially with tube 54. The internal diameter of cylindrical conduit 60 is greater than the external diameter of mouth 58 in such a manner as to cause an aspiration or suction effect of the coolant liquid which flows successively through tube 54 and then through conduit 60 to flow into expansion chamber 22. By virtue of the space found between the end 64 of tube 60 and the mouth 58 of tube 54, which may be on the order of a few millimeters, the air bubbles which may be present under partition 46 are aspirated by the fluid in its circulation. Tube 54 here plays not only its normal role of circulation of the coolant, operating the same as the other tubes 34 of the bottom part of the cluster, but also contributes to the degasification of compartment 52 of second collector reservoir 20 and to the degasification of first collector reservoir 16.

As is to be seen in FIG. 2, cylindrical conduit 60 is situated in the immediate vicinity of transverse partitions 46, without, however, being fastened to this partition so as to allow the bubbles of air which may be present more easy access into the space between conduit 60 and mouth 58, on the entire periphery of the conduit. Alternately conduit 60 may be fastened to the partition.

Conduit 60 is a part of the configuration of longitudinal partition 18 which separates second collector reservoir 52 and expansion chamber 22 and it extends integrally into second collector reservoir 20.

In the embodiment which is described, conduit 60 is obtained by molding as one single piece integral with partition 18. Further, a deflector 66, part of the configuration of longitudinal partition 18, is provided in expansion chamber 22 facing the mouth of conduit 60 to direct the liquid and the air bubbles which may be present toward the top part of expansion chamber 22. Here also, deflector 66 is provided by the molding as one single piece integral with the longitudinal partition. The assembly of water reservoir 14 therefore may be obtained by molding as one single piece. In wall 40 of water reservoir 14 is also provided a flange arrangement 68 to allow the placement of a level detector (not shown) inside expansion chamber 22, this detector being situated for instance slightly above the median horizontal plane of water reservoir 14.

The heat exchanger of the invention operates in the following manner. The coolant liquid circulates from the inlet pipe 42 to the discharge pipe 44 in the manner described in the preceding text. The air or gas bubbles being carried by the liquid have a tendency to gather together and collect in the top part of first collector reservoir 16 and in the top part of compartment 52 under partition 46. The air or gas bubbles which may be present in first collector reservoir 16 are aspirated through tube 54 and through conduit 60 and are then evacuated toward expansion chamber 22. In the same manner, air or gas bubbles which may be present in compartment 52 are aspirated through conduit 60 and evacuated toward expansion chamber 22.

It is to be noted that the degasification passage according to the invention may comprise several tubes identical to tube 54, for instance two adjacent tubes, conduit 60 then having an appropriate form to align therewith, for instance a generally oval cross section.

The mounting of the exchanger of the invention is particularly simple to execute since it suffices to mount the two water reservoirs 12 and 14 on corresponding collectors 30 and 38 in the traditional manner and to provide that the different tubes composing the cluster are all identical.

The present invention is not limited to the example described above but rather includes all variations and modifications.

Particularly the collector reservoir may operate without any transverse separator partition.

In this case, the degasification passage is situated in the top of the exchanger and particularly conduit 60 is in the vicinity of the top horizontal wall of collector reservoir 20. Further, the collector reservoir 20 may be subdivided into three compartments by two transverse partitions, with each of the partitions being associated with a degasification passage.

I claim:

1. A heat exchanger with liquid circulation, particularly for an automobile, comprising a cluster (10) of tubes in which the liquid circulates, said cluster of tubes having opposed ends, at least one collector reservoir (20) mounted at one end of the cluster (10), said collector reservoir having a bottom end, an expansion chamber (22) in communication with said collector reservoir at its bottom end and a liquid degasification passage connecting the collector reservoir (20) to the expansion chamber (22) for evacuation of air bubbles, the collector reservoir (20) having at least one transverse wall situated above the level of the degasification passage, the degasification passage comprising at least one tube (54) of the cluster (10) with a mouth (58) situated at a level below that of the transverse wall and a cylindrical conduit (60) which opens into the expansion chamber (22) and into the collector reservoir (20), the conduit, in the collector reservoir, opening toward and being closely spaced from the mouth (58) of said at least one tube (54) to define a space between the conduit and the tube mouth (58), said tube mouth (58) of said at least one tube being directed toward the conduit for axial liquid flow from said at least one tube across said space and into said conduit for aspiration of liquid, and entrained air bubbles, from said collector reservoir into said space and through said conduit (60) with said liquid flow for discharge into said expansion chamber (22).

2. A heat exchanger as in claim 1, wherein the transverse wall is a transverse partition (46), situated in the collector reservoir (20) and separating the reservoir into two compartments, permitting the fluid to circulate through the tubes of the cluster in a first direction and then in an opposite direction to the first direction.

3. A heat exchanger as in claim 1, wherein the degasification passage comprises one single tube (54) of the cluster, this tube being of generally cylindrical shape and being axially aligned with the conduit (60).

4. A heat exchanger as in claim 3, wherein the internal diameter of the cylindrical conduit (60) is greater than the external diameter of the mouth (58) of the tube (54) of the cluster.

5. A heat exchanger as in claim 3, wherein the mouth (58) of the tube (54) of the cluster is flared.

6. A heat exchanger as in claim 2, wherein the degasification passage comprises one single tube (54) of the cluster, this tube being of generally cylindrical shape and being axially aligned with the conduit (60).

7. A heat exchanger as in claim 6, wherein the internal diameter of the cylindrical conduit (60) is greater than the external diameter of the mouth (58) of the tube (54) of the cluster.

8. A heat exchanger as in claim 1, wherein the conduit (60) is situated in the immediate vicinity of the transverse wall, and spaced from this transverse wall.

9. A heat exchanger as in claim 1, wherein the conduit (60) is fixed to the transverse wall.

10. A heat exchanger as in claim 1, including a longitudinal partition (18) separating the collector reservoir (52) and the expansion chamber (22), the conduit (60) being a part of the partition and extending integrally into the collector reservoir (20).

11. A heat exchanger as in claim 10, wherein the conduit (60) is integral with the longitudinal partition (18).

12. A heat exchanger as in claim 10, wherein the expansion chamber (22), the collector reservoir (20), the longitudinal partition (18) and the conduit (60) are of one cast single piece.

13. A heat exchanger with liquid circulation, particularly for an automobile, comprising a cluster (10) of tubes in which the liquid circulates, said cluster of tubes having opposed ends, at least one collector reservoir (20) mounted at one end of the cluster (10), said collector reservoir having a bottom end, an expansion chamber (22) in communication with said collector reservoir at its bottom end and a liquid degasification passage connecting the collector reservoir (20) to the expansion chamber (22) for evacuation of air bubbles, the collector reservoir (20) having at least one transverse wall situated above the level of the degasification passage, and defining a collector reservoir compartment between the transverse wall and the bottom end of the collector reservoir, the degasification passage comprising means for aspirating liquid and entrained air bubbles from said collecting reservoir compartment, said means for aspirating including at least one tube (54) of the cluster (10) with a mouth (58) situated at a level immediately below that of the transverse wall and a conduit (60) which opens into the expansion chamber (22) and into the collector reservoir compartment, the conduit, in the collector reservoir compartment, opening toward and being closely spaced from the mouth (58) of said at least one tube (54) to define a space between the conduit and the tube mouth (58), said tube mouth (58) of said at least one tube being directed toward the conduit for axial liquid flow from said at least one tube across said space and into said conduit for the aspiration of liquid, and entrained air bubbles, from said collector reservoir compartment into said space and through said conduit (60) with said liquid flow for discharge into said expansion chamber (22).

* * * * *